United States Patent [19]

Bittenbinder

[11] Patent Number: 4,838,504

[45] Date of Patent: Jun. 13, 1989

[54] BAG-HOLDING ARTICLE

[76] Inventor: Stefan Bittenbinder, Apartment 5
6736 Los Verdes Dr., Rancho Palos Verdes, Calif. 90274

[21] Appl. No.: 142,000

[22] Filed: Jan. 6, 1988

[51] Int. Cl.[4] ..... B65B 67/04

[52] U.S. Cl. ..... 248/100; 248/223.4

[58] Field of Search ..... 248/223.4, 224.3, 222.2, 248/225.1, 311.2, 100, 99, 97, 95; 211/88; 53/390; 141/314, 391; 232/43.2

[56] References Cited

U.S. PATENT DOCUMENTS

| | | | |
|---|---|---|---|
| 1,679,450 | 8/1928 | Thompson | 248/100 |
| 3,003,734 | 10/1961 | Davis et al. | 248/223.4 X |
| 4,398,689 | 8/1983 | Prader | 248/99 |
| 4,579,307 | 4/1986 | Malik | 248/97 X |
| 4,669,690 | 6/1987 | McEniry | 248/101 |

FOREIGN PATENT DOCUMENTS

| | | | |
|---|---|---|---|
| 119949 | 10/1947 | Sweden | 248/101 |
| 372550 | 5/1932 | United Kingdom | 248/97 |

*Primary Examiner*—J. Franklin Foss
*Attorney, Agent, or Firm*—Bright & Lorig

[57] ABSTRACT

An article adapted for holding, by its loops, in a substantially open position, a bag such as a plastic supermarket bag having at least two loops at or near the top of the bag includes a substantially flat, elongated, generally rectangular-shaped base member for attaching the article to a vertically-oriented flat surface such as a wall and, attached to the base member, at substantially right angles, two bag-supporting members at substantially opposite ends of the base member. The bag-supporting members are disposed in parallel to one another, and include hooks at each end to engage one of the two bag loops.

9 Claims, 2 Drawing Sheets

BAG-HOLDING ARTICLE

This invention relates to an article adapted for use in holding, by its loops, in a substantially open position, a container such as a bag having at least two loops at or near the top of the bag. The article preferably comprises a substantially flat, generally rectangular-shaped, substantially planar base member that includes means for attaching the article to a flat, preferably vertically-oriented surface such as a wall. The base member also includes means for attaching at substantially right angles to, and preferably at substantially opposite ends of the base member, two bag-supporting members.

In preferred embodiments, the base member includes, preferably at or near each end, a slot, preferably U-shaped, formed at substantially right angles to the longitudinal axis of the base member, to receive notch means formed at or near the end of each bag-supporting member. This notch has a size and shape complementary to the opening or slot on the base member. Preferably, when the notch is engaged in the slot in the base member, the end of the bag-supporting member is flush with the planar surface at the back of the base member.

The two bag-supporting members, when attached to the base member, are disposed substantially in parallel to one another, and are spaced apart a distance sufficient to hold, in open position, a bag having at least two loops at or near the top of the bag when one of the bag loops is attached to one of the bag-supporting members, and a second bag loop is attached to the other bag-supporting member. Each of the bag-supporting members comprises at least two, preferably integrally formed, loop-engaging openings, one projecting forwardly, the other projecting rearwardly, of the lateral axis of the bag-supporting members. Each of these two openings on each of the bag-supporting members is adapted to engage one of the loops on the bag. Preferably, these openings are C-shaped, U-shaped or V-shaped. Preferably, each bag-supporting member includes at one end, means such as notch means, preferably integrally formed notch means, for engaging a slot or other opening at or near one end of the base member.

In preferred embodiments, the bag-supporting member has chamfered portions extending along its entire length on each side of its upper edge. The bag-supporting member also has chamfered portions that extend along each side of the lower edge, but terminate a short distance from the end of the bag-supporting member that includes notched means. The thicker wall portion there strengthens the bag-supporting member at that end.

The article of this invention can better be understood by reference to the drawings, in which.

Figure 4:
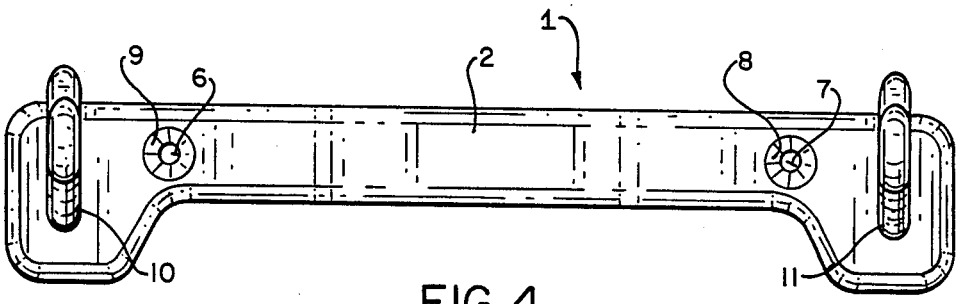
FIG. 4 shows a rear elevation view of the article shown in FIGS. 1–3, with the bag-supporting members partially, but not completely seated into the notches at opposite ends of the base member.
Figure 5:
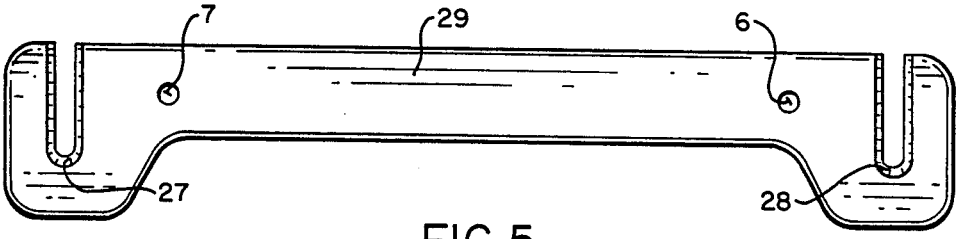
Figure 6:
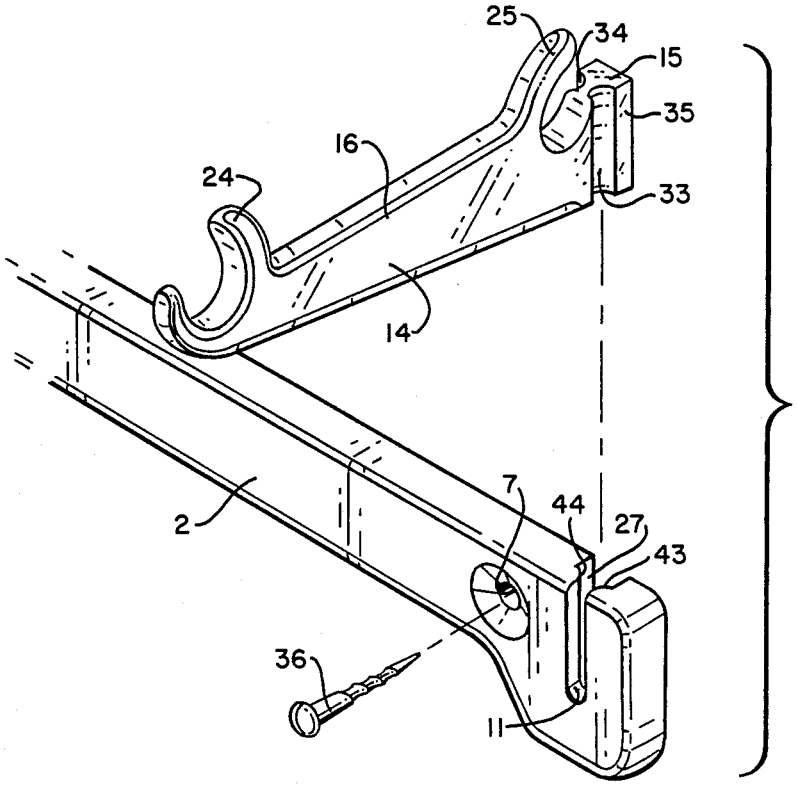

FIG. 5 shows a front elevation view of the base member of article shown in FIGS. 1–4 with the bag-supporting members detached from the article; and FIG. 6 shows an exploded perspective view of one of the bag-supporting members, and an end portion of the base member of the article depicted in FIGS. 1–5, and shows how the notch at the end of the bag-supporting member engages the slot near the end of the base member.

Figure 1:
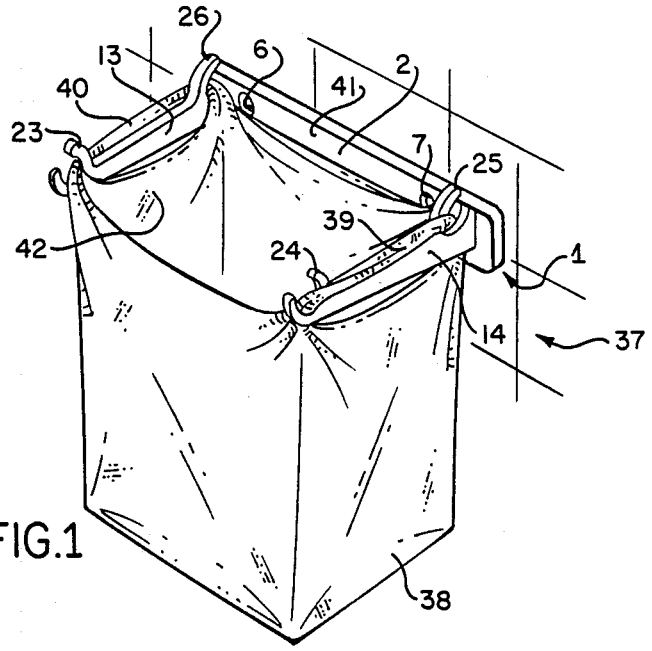
FIG. 1 shows a preferred embodiment of the bag-holding article attached to a wall surface, and holding open a plastic bag having two loops on opposite sides of the bag at its end of the bag.

FIG. 1 shows a preferred embodiment of a bag-holding article 1 attached to substantially vertically-oriented wall surface 37. Article 1 includes substantially flat, substantially planar base member 2 having screw-receiving openings 6 and 7 in countersunk regions 8 and 7 through which screws pass, anchoring base member 2 to wall surface 37. Bag 38 is attached to article 1 by loops 39 and 40 alongside opening 42 at the top of bag 38. Bag 38 may be, for example, the kind of plastic bag used for groceries in supermarkets.

Figure 2:
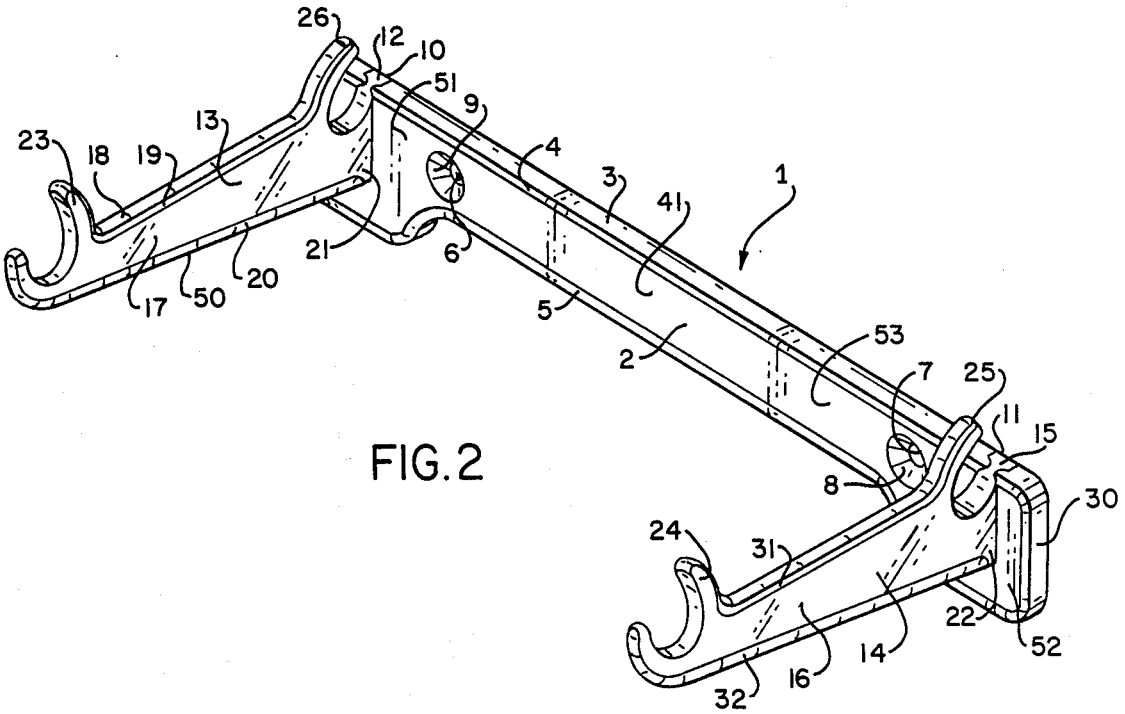
FIG. 2 shows a perspective view of the article shown in FIG. 1, but with no bag attached to the article.
Figure 3:
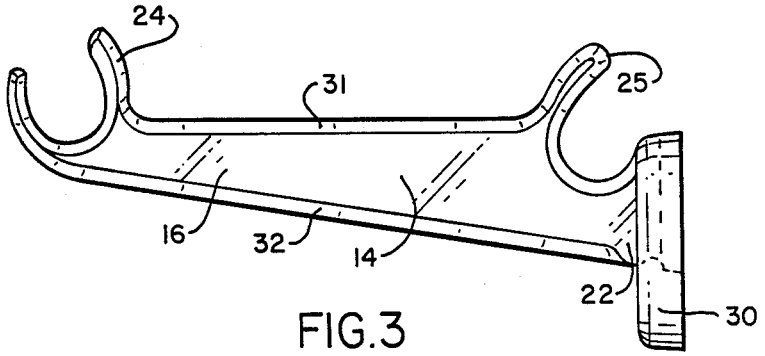
FIG. 3 shows a side elevation view of one of the bag-supporting members attached to the article shown in FIGS. 1 and 2, detached from the base member of the bag-holding article.

FIGS. 2, 4 and 5 show that base member 2 has a substantially flat front surface 41, is generally rectangular in shape and has end portions 57 and 52 that are shorter in length than longer, narrower center portion 53. Extending along the intersections of the front and back side walls, and the upper and lower walls of base member 2 are longitudinally-extending grooves 4 and 5.

Joined to base member 2 at substantially right angles are bag-supporting members 13 and 14. Bag-supporting arms 13 and 14 are attached at substantially opposite ends of base member 2 and extend outwardly therefrom, in parallel to one another. Bag-supporting arms 13 and 14 are spaced apart along the longitudinal axis of base member 2 a distance sufficient to hold bag 37 open when loops 39 and 40 are engaged with arms 13 and 14.

Each of arm members 13 and 14 has two hook-shaped openings at or near its opposite ends. These two hook-shaped openings on each arm are adapted to engage one of the loops at the top of bag 38. For example, hook-shaped openings 24 and 25 disposed at opposite ends of arm member 14 are spaced apart from one another a distance sufficient to hold bag 38 open, and to prevent loop 39 from inadvertent detachment. U-shaped hook member 24 has its opening disposed upwardly and slightly forwardly, with respect to the lateral axis of arm 14. U-shaped hook member 25 has its opening disposed upwardly and slightly rearwardly with respect to the lateral axis of arm 14. Hooks 24 and 25 cooperate to prevent loop 39 at the top of bag 38 from inadvertently, and undesirably, disengaging from arm 14 when objects are placed inside bag 38. Hooks 23 and 26 on arm member 13 are substantially identical in size, shape, arrangement and disposition to hooks 24 and 25 on arm member 14, and function in substantially the same way.

FIGS. 2-6 show in greater detail the construction and assembly of the bag-holding article. Article 1 includes 3 separate members: base member 2 and bag-supporting arms 13 and 14. As FIG. 6 shows, bag-supporting member 14 is attachable to, and detachable from base member 2. Base member 2 includes, at or near its end portion 30, vertically-oriented, U-shaped slot or opening 11. Behind slot 11 is T-shaped opening 27 having rounded-profile side walls 43 and 44.

As FIG. 6 also shows, bag-supporting arm 14 has, at its rear end, vertically-oriented, rounded-profile grooves 33 and 34 formed in T-shaped, vertically-oriented end portion 15. Grooves 33 and 34 are, in size and shape, complementary to the rounded-profile side walls 43 and 44 to permit engagement when bag-supporting arm 14 is attached to base member 2.

Bag-supporting members 13 and 14 have substantially flat inner and outer side walls 16 and 17. Arm 13 also has a flat upper wall 18 and, at the intersection of upper wall 18 with side wall 17, a longitudinally-extending groove 19 extending substantially from one end of member 13 to its other end. A similar groove 20 extends longitudinally along the intersection of bottom wall 50 with side wall 17, but groove 20 terminates at thickened side wall portion 21. Portion 21 strengthens arm 13 where arm 13 attaches to base member 2. Bag-supporting arm 14 has a similar thickened area 22, and similar grooves 31 and 32 at the intersections of its side walls with its upper and lower walls.

What is claimed is:

1. An article adapted for use in holding, by its loops, in a substantially open position, a bag having at least two loops at or near the top of said bag, said article comprising: a base member including means for attaching said base member to a flat surface, and means for attaching, at substantially right angles to said base member, two bag-supporting members, two substantially similar bag-supporting, loop-engaging members, disposed substantially in parallel to one another, and attached to said base member at one end of said bag-supporting member, said bag-supporting members being spaced apart a distance sufficient to hold said bag open when said at least two loops on said bag are attached to said bag-supporting members, each of said bag-supporting, loop-engaging members comprising at least two loop-engaging hooks at substantially opposite ends of said bag-supporting members, the opening in one of said hooks projecting upwardly and slightly forwardly with respect to the lateral axis of said bag-supporting member, the opening in another hook projecting upwardly and slightly rearwardly with respect to the longitudinal axis of said bag-supporting member, said hooks being spaced apart along said bag-supporting member a distance sufficient to hold said bag substantially open when said bag loops are attached to said bag hooks.

2. The article of claim 1 further comprising at least two, spaced-apart openings for receiving means for attaching said base member to a flat supporting surface.

3. The article of claim 1 wherein said hooks are substantially C-shaped and are integrally formed in said bag-supporting member.

4. The article of claim 1 wherein said bag-supporting members are attachable to and detachable from said base member.

5. The article of claim 1 wherein the bag-supporting members have, at one end, slot-engaging means and said base member has, at substantially opposite ends, slots for receiving said slot-engaging means at the end of said bag-supporting members.

6. An article adapted for use in holding, by its loops, in a substantially open position, a bag having at least two loops at or near the top of said bag, said article consisting of three inter-fitting members, including: a base member including means for attaching said base member to a surface, and means for attaching, at substantially right angles to said base member, two bag-supporting members; two substantially similar, substantially flat-sided, bag-supporting, loop-engaging members, disposed substantially in parallel to one another, and attached to said base member at one end of said bag-supporting member, each of said bag-supporting, loop-engaging members comprising at lest two loop-engaging hooks at substantially opposite ends of said bag-supporting members, the opening in one of said hooks projecting upwardly and slightly forwardly with respect to the lateral axis of said bag-supporting member, the opening in another hook projecting upwardly and slightly rearwardly with respect to the longitudinal axis of said bag-supporting member, said hooks being spaced apart along said bag-supporting member a distance sufficient to hold said bag substantially open when said bag loops are attached to said bag hooks.

7. The article of claim 6 wherein said hooks are substantially C-shaped and are integrally formed in said bag-supporting member.

8. The article of claim 6 wherein said bag-supporting members are attachable to and detachable from said base member.

9. The article of claim 6 wherein the bag-supporting members have, at one end, slot-engaging means and said base member has, at substantially opposite ends, slots for receiving said slot-engaging means at the end of said bag-supporting members.

* * * * *